US007486496B2

(12) United States Patent
Gauxmann et al.

(10) Patent No.: US 7,486,496 B2
(45) Date of Patent: Feb. 3, 2009

(54) METHOD AND CIRCUIT ARRANGEMENT FOR OPERATING A SOLENOID ACTUATOR

(75) Inventors: Berthold Gauxmann, Bonn (DE); Holger Neubert, Dresden (DE); Thomas Roschke, Amsdorf (DE)

(73) Assignee: Moeller GmbH, Bonn (DE)

( * ) Notice: Subject to any disclaimer, the term of this patent is extended or adjusted under 35 U.S.C. 154(b) by 309 days.

(21) Appl. No.: 10/599,585

(22) PCT Filed: Mar. 23, 2005

(86) PCT No.: PCT/EP2005/051335

§ 371 (c)(1),
(2), (4) Date: Oct. 2, 2006

(87) PCT Pub. No.: WO2005/096327

PCT Pub. Date: Oct. 13, 2005

(65) Prior Publication Data

US 2007/0223172 A1 Sep. 27, 2007

(30) Foreign Application Priority Data

Apr. 1, 2004 (DE) ..... 10 2004 015 932

(51) Int. Cl.
*H01H 47/00* (2006.01)

(52) U.S. Cl. ..... 361/147; 361/139

(58) Field of Classification Search ..... 361/147
See application file for complete search history.

(56) References Cited

U.S. PATENT DOCUMENTS 4,947,146 A 8/1990 Ichimura et al.
4,972,810 A 11/1990 Kawamura et al.
5,214,560 A 5/1993 Jensen
6,009,615 A * 1/2000 McKean et al. ..... 29/602.1
6,246,131 B1 6/2001 Sheng et al.
2005/0162796 A1 7/2005 Arenz et al.

FOREIGN PATENT DOCUMENTS

| | | |
|---|---|---|
| DE | 3908319 | 9/1990 |
| DE | 29909901 | 9/1999 |
| DE | 19954037 | 5/2001 |
| DE | 19958888 | 6/2001 |
| DE | 20113647 | 10/2001 |

(Continued)

*Primary Examiner*—Michael J Sherry
*Assistant Examiner*—Dharti H Patel
(74) *Attorney, Agent, or Firm*—Darby & Darby

(57) ABSTRACT

A method for operating an electromagnetic operating mechanism includes, upon application of a control voltage, resetting and initializing a control circuit and starting a charging of a charge storage device. Subsequently, an auxiliary tripping coil and a main tripping coil are sequentially briefly energized, and, if no current flow occurs through at least one of the tripping coils, the control voltage is permanently disconnected. If a current flow occurs through each of the tripping coils, a closing coil is energized so as to move the armature to an attracted position, and the closing coil is subsequently de-energized. Subsequently, sequentially briefly energizing the auxiliary tripping coil and the main tripping coil are sequentially briefly energized without affecting the armature. Upon removal of the control voltage, the charge storage device is discharged through the main tripping coil so as to move the armature to the dropped-out position.

21 Claims, 5 Drawing Sheets

FOREIGN PATENT DOCUMENTS

| | | |
|---|---|---|
| DE | 10129153 | 1/2003 |
| DE | 10133713 | 3/2003 |
| DE | 10146110 | 4/2003 |
| EP | 0376715 | 7/1990 |
| EP | 0721650 | 7/1996 |
| EP | 995997 | 4/2000 |
| WO | WO-03077396 | 9/2003 |

* cited by examiner

METHOD AND CIRCUIT ARRANGEMENT FOR OPERATING A SOLENOID ACTUATOR

CROSS REFERENCE TO PRIOR APPLICATION

This is a U.S. national phase application under 35 U.S.C. §371 of International Patent Application No. PCT/EP2005/051335, filed Mar. 23, 2005, and claims benefit of German Patent Application No. 10 2004 015 932.7, filed Apr. 1, 2004, which is incorporated by reference herein. The International Application was published in German on Oct. 13, 2005 as 2005/096327 A1 under PCT Article 21(2).

The present invention relates to both a method and a circuit arrangement for operating an electromagnetic operating mechanism which is formed by a magnet yoke, at least one permanent magnet disposed on the side of the magnet yoke, an armature, and retaining means exerting a retaining force, an electromagnetic coil means surrounding the magnet yoke, a control circuit supplied with a rectified control voltage applied to its input and containing a microcontroller, and a capacitive charge storage device. Upon application of the control voltage, the armature is attracted against the retaining force, assisted by permanent-magnet action, then held exclusively by permanent-magnet action while the control voltage remains applied, and when the control voltage is removed, the armature drops out with the assistance of the retaining force and against the permanent-magnet holding force through discharging of the charge storage device.

BACKGROUND

Electromagnetic operating mechanisms include a magnet yoke, an operating coil, and an armature which is attracted by the magnet yoke when the operating coil is sufficiently energized. Electromagnetic operating mechanisms are used in electromagnetic switching devices (also referred to as contactors) for connecting and disconnecting an electric load to and from an electric power network by closing or opening the main contacts coupled to the armature. For reasons of safety, the regulations relevant to these switching devices require the load to be disconnected from the network when the control input of the electromagnetic operating mechanism is de-energized.

Therefore, electromagnetic switching devices usually have electromagnetic operating mechanisms which hold the main contacts open using return springs when the operating coil is in the de-energized state. It is a disadvantage of such electromagnetic operating mechanisms that, in order to maintain the main contacts closed, a holding current through the solenoid coil, and thus a holding power, are required, as result of which waste heat is generated during operation, requiring the electrical system to be thermally designed accordingly.

German Publication DE 101 29 153 A1 describes an electromagnetic valve in which a higher pull-in current is reduced to a lower holding current. The solenoid coil field or the solenoid coil current, which change when the valve is switched, are detected by sensor means in the form of a magnetic field sensitive switch or a current sensor for the coil current in order to change to the holding current. German Publication DE 299 09 901 describes a microprocessor control for an electromagnetic operating mechanism, where the holding current is minimized through pulse-width control. An electromagnetic switching device known from DE 39 08 319 A1 has a permanent magnet in the magnet yoke in order to reduce the pull-in power and holding power required. German Patent DE 101 33 713 C1 describes an electromagnetic operating mechanism which also has a permanent magnet in the magnet yoke and in which the required holding force is provided by said permanent magnet alone. When disconnecting the control voltage, a mechanical locking mechanism, which has been held by an auxiliary electromagnetic operating mechanism up to that point, is released, as a result of which a spring force counteracting the permanent magnet is released by the mechanical locking mechanism in order for the armature to drop out. However, the electromagnetic operating mechanisms mentioned above still require considerable holding power and auxiliary power, respectively.

European Patent EP 0 721 650 B1 discloses a bistable magnetic actuator having permanent magnets disposed between a magnet yoke and a two-piece armature and including two individually energizable solenoid coils. A low reluctance flux path and a high reluctance flux path are formed in each of the bistable positions of the armature. Energization of the solenoid coil linked to the high reluctance flux path causes the armature to move from one stable position to the other, thus swapping over the low reluctance flux path and the high reluctance flux path. In an electromagnetically controlled valve operating mechanism according to EP 0 376 715 B1, the holding state is brought about solely by a permanent magnet in the magnet yoke. On the other hand, the pulling in and dropping out of the armature is brought about by the suitably polarized brief discharging of a storage capacitor which has been charged in the preceding dropped-out state or holding state. German Publication DE 199 58 888 A1 describes a so-called remanent actuator, whose armature assumes the OFF position, on the one hand, and the ON position, on the other hand, between two permanent magnets disposed opposite each other and in oppositely poled relationship in the magnet yoke. The armature is moved from one position to the other and vice versa by briefly charging and discharging a capacitor, respectively. German Publication DE 201 13 647 U1 describes an electromagnetic operating mechanism for an electromagnetic switching device, said electromagnetic operating mechanism also having a permanent magnet which is disposed in a double-circuit magnet yoke and which provides the holding force alone. A storage capacitor charged during the holding mode is discharged through the auxiliary circuit in order for the armature to drop out. In the electromagnetic operating mechanisms mentioned above, no measures are taken for the armature to reliably drop out when the control power fails.

German Publication DE 101 46 110 A1 discloses an electronic circuit arrangement having a microcontroller for switching an electromagnetic operating mechanism from the electromagnetic pull-in mode to the permanent-magnetic holding mode. When the control voltage is removed, the brief discharge current of a storage capacitor is used to demagnetize the magnetic circuit, and thus, to cause the armature to drop out. The document does not specify any means to prevent the electromagnetic operating mechanism from remaining in the holding mode in the event of a defect of the circuit arrangement. A microprocessor-controlled trip solenoid of a circuit breaker having permanent-magnetic holding force is known from DE 199 54 037 A1. In order to test the holding force, the trip coil is loaded with brief current pulses at regular intervals. In case of a decrease in the holding force, tripping is performed prematurely for reasons of safety.

SUMMARY

It is therefore an object of the present invention for an electromagnetic operating mechanism having a permanent-magnetic holding mode to be reliably brought to the dropped-out state both after the control power is disconnected and after the occurrence of defects. In an embodiment, the present invention provides a method for operating an electromagnetic operating mechanism including a magnet yoke, a permanent magnet, an armature, and electromagnetic coil device, a control circuit including a microcontroller, the electromagnetic operating mechanism having:

a permanent-magnet assisted electromagnetic pull-in mode provided against a retaining force upon application of a control voltage to the control circuit;

a subsequent, permanent-magnetic holding mode provided while the control voltage remains applied; and a drop-out mode provided electromagnetically against the permanent-magnetic holding force and assisted by the retaining force, a capacitive charge storage device charged during the pull-in and holding modes being discharged upon removal of the control voltage so as to cause the drop-out mode.

The method comprises the following steps:

A) upon application of the control voltage, resetting and initializing the control circuit and starting a charging of the charge storage device;

B) subsequently sequentially briefly energizing an auxiliary tripping coil and a main tripping coil, and, if no current flow occurs through at least one of the auxiliary and main tripping coils, permanently disconnecting the control voltage;

C) if a current flow occurs through each of the tripping coils, energizing a closing coil so as to move the armature to an attracted position, and subsequently de-energizing the closing coil;

D) subsequently sequentially briefly energizing the auxiliary tripping coil and the main tripping coil without affecting the armature, and if no current flow occurs through the auxiliary tripping coil, discharging the charge storage device through the main tripping coil so as to move the armature to a dropped-out position, if no current flow occurs through the main tripping coil, energizing the auxiliary tripping coil so as to move the armature to the dropped-out position, and then permanently disconnecting the control voltage;

E) if a current flow occurs through each of the tripping coils, re-starting step D; and F) upon removal of the control voltage, discharging the charge storage device through the main tripping coil so as to move the armature to the dropped-out position.

BRIEF DESCRIPTION OF THE DRAWINGS

Further details and advantages of the present invention will become apparent from the exemplary embodiments described below with reference to the Figures, in which.

DETAILED DESCRIPTION

Figure 1:
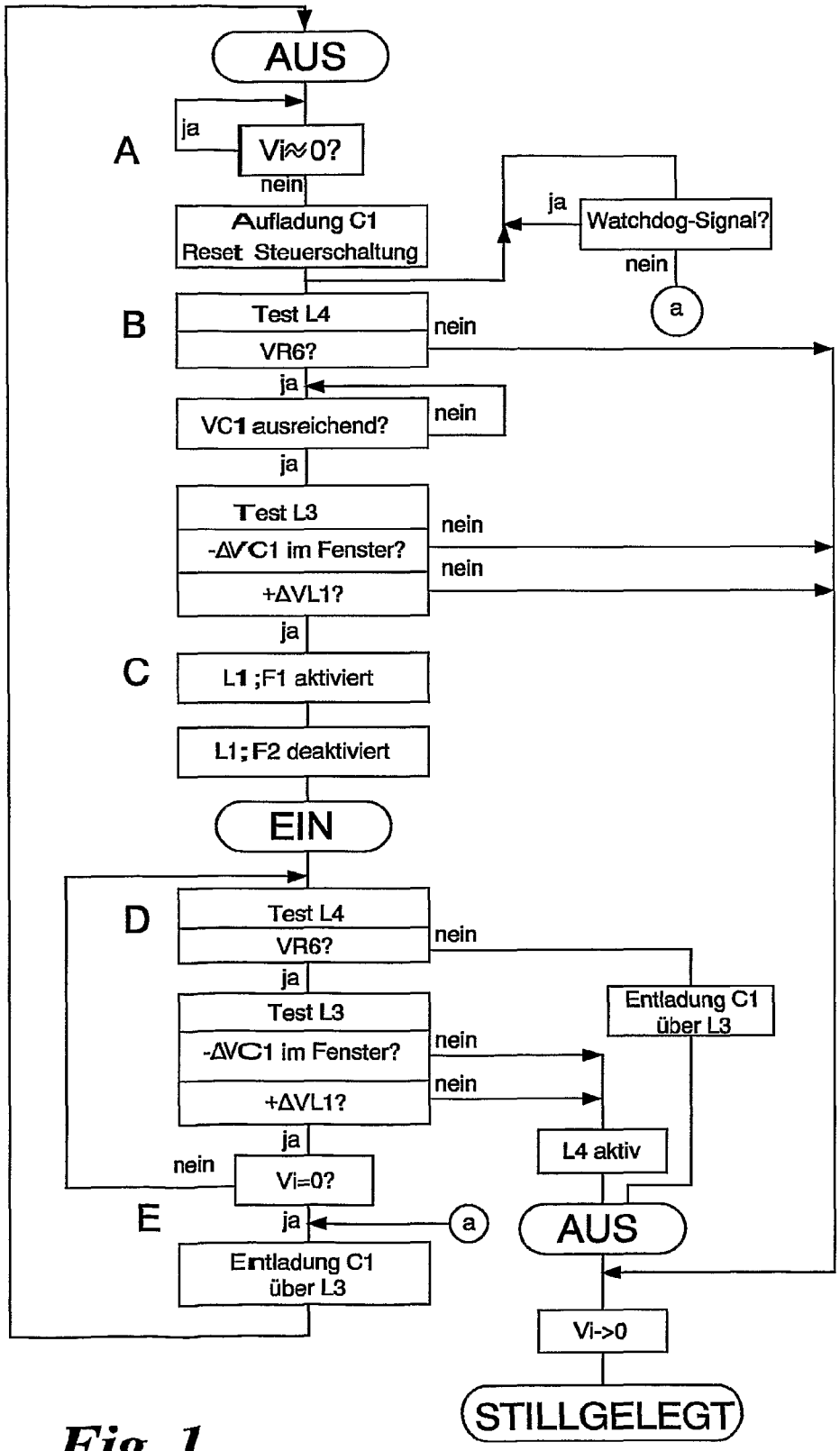
FIG. 1 is a flow chart illustrating the method of the present invention.

The method of the present invention is based on that the pulling in and dropping out of the armature is accomplished using separate coil means. The pull-in mode is accomplished using a main tripping coil in a generally known manner in accordance with method step C. In the normal case, dropping out is accomplished by discharging a previously charged charge storage device through a main tripping coil in accordance with method step E. In case the drop-out mode via the main tripping coil fails, dropping out can also be accomplished using a redundant auxiliary tripping coil. In order to provide high technical reliability, method step D provides for test steps to be performed on a regular basis by briefly energizing in each instance one of the tripping coils without causing the armature to be moved out of its holding position. If the testing shows that there is a failure in one of the tripping coils in terms of its drop-out capability, the respective other tripping coil causes the armature to positively drop out. After that, the control voltage is positively and permanently disconnected to prevent the faulty electromagnetic operating mechanism assembly from being re-energized. After the method is initialized by applying the control voltage and initializing the control circuit in accordance with method step A, and even before the pull-in mode is initialized, the tripping coils are tested accordingly and, in the event of a defect, the control voltage is subsequently permanently disconnected, in accordance with method step B. The method ensures, on the one hand, that the electromagnetic operating mechanism changes from the permanent-magnetic holding mode to the dropped-out state of its armature with certainty, both when the electromagnetic operating mechanism is intentionally de-energized and when the control voltage fails. On the other hand, the method ensures that the electromagnetic operating mechanism permanently assumes or remains in the dropped-out state when faults are detected, such as broken wires in or to the coil means, or defects in the control circuit. The holding energy consumed by the method is only the energy for recharging the charge storage device and for supply to the electronic control circuit.

In order to make the method less sensitive to changes in the control voltage and in the charging behavior of the charge storage device, the first testing of the tripping coils is advantageously carried out only after the charge storage device is sufficiently charged. Advantageously, the permanent disconnection of the control voltage in the event of a fault is accomplished by short-circuit tripping.

On the one hand, the brief current flow through the auxiliary tripping coil can advantageously be detected as a brief voltage drop across a resistance. On the other hand, the brief current flow through the main tripping coil can be detected as a brief voltage drop at the charge storage device. After such a voltage drop, the charge storage device must still have enough charge to perform the normal drop-out mode. In this connection, it is advantageous to check the voltage across the charge storage device during the voltage drop as to whether it is within a tolerance window in order for the control voltage to be permanently disconnected as a precautionary measure also in the event of a decrease in the charging capacity.

One advantageous embodiment of the method checks whether an inductive voltage rise occurs at the closing coil during the testing of the tripping coils and initiates permanent disconnection if such voltage rise fails to occur. Failure of occurrence of such a voltage rise is generally attributable to permanent energization of the closing coil as a result of a defect.

In another advantageous embodiment, a microcontroller decisively involved in the implementation of the method is constantly monitored, and the dropped-out state is maintained or assumed by energizing one of the two tripping coils in the event of a failure of the microcontroller, such as in the event of a program crash.

The retaining force acting on the armature to ensure the dropped-out state is advantageously produced by at least one return spring and/or by at least one further permanent magnet.

Moreover, starting from a circuit arrangement of the type mentioned at the outset, the object is achieved according to the present invention by the features of the independent device claim while advantageous refinements of the circuit arrangement will be apparent from the subordinate claims.

The separate coil means in the form of a closing coil, a main tripping coil, and an auxiliary tripping coil, which provides redundancy for the main tripping coil, as well as switching elements coupled to these coils, in conjunction with a control circuit, allow the electromagnetic operating mechanism to be optimally designed with respect to its switching behavior and its energy consumption. Also provided are current- and voltage-monitoring means as sensors for current surges which are expected to occur regularly and alternately and which should occur when the disabling branches are tested by causing the corresponding disabling elements to be briefly closed without affecting the armature. If the control voltage disappears, whether through intentional control or because of a defect in the supply feeder, the main disabling element is closed in order to return the armature to the dropped-out position by discharging the charge storage device through the main tripping coil. When a test fails, and possibly after the armature is returned to the dropped-out position by closing the main or auxiliary disabling element, a microcontroller connected to the detecting means and to the switching elements trips a permanent interrupting element for the control voltage in order to prevent the faulty operating mechanism assembly from being re-energized.

The permanent interrupting element is simply designed as a short-circuit protective device having a downstream short-circuit switching element. As an alternative to the short-circuit protective device, it is possible to provide a conductor track with a weak point which is responsive to heat. An advantageous refinement is obtained when an active low-pass filter is placed between the closing coil and the short-circuit switching element. When the enabling branch is properly activated in a pulse-controlled manner, a charging capacitor is alternately charged and discharged without reaching a charge voltage which would trip the short-circuit switching element. Should the enabling element be permanently closed, i.e., permanently conducting, because of a defect, then the charging capacitor quickly reaches a charge voltage which trips the short-circuit switching element.

Advantageously, the current-monitoring means are formed by a current-sensing resistor placed in series with the auxiliary tripping coil, and a downstream first amplifier circuit.

Advantageously, the voltage-sensing means are formed by a high-pass filter connected to the charge storage device, and a downstream second amplifier circuit. During the testing of the main disabling branch, it is detected whether the voltage drop at the charge storage device caused by the current surge in the main tripping coil is within a predeterminable window. In a refinement of the circuit arrangement, a third amplifier circuit originating at the charging capacitor signals the microcontroller when a minimum charge voltage required for testing the disabling branches has been reached. It is also advantageous if the closing coil, which is activatable in a pulse-controlled manner, is connected to a free-wheeling circuit which can be deactivated outside the pull-in mode and to a fourth amplifier circuit which monitors the deactivation function of the free-wheeling circuit. The fourth amplifier circuit detects the occurrence of brief voltage rises which are induced in the closing coil by the current surges in one of the tripping coils during the testing of the respective disabling branch. If the free-wheeling circuit cannot be deactivated because of a defect, a short-circuit develops for the expected voltage rises, so that no voltage rises are signaled by the fourth amplifier circuit to the microcontroller, whereupon the microcontroller trips the permanent interrupting element. This prevents that, in the drop-out mode, additional charge flows off the charge storage device because of the closing coil being short-circuited through the non-deactivated free-wheeling circuit, which could result in that the remaining charge would not be sufficient to properly return the armature.

The retaining means provided to ensure the dropped-out state of the armature advantageously take the form of at least one return spring and/or at least one further permanent magnet.

The method described below with reference to FIG. 1 is used to operate an electromagnetic operating mechanism which, as is generally known, includes a magnet yoke, at least one permanent magnet connected thereto, an armature movable with respect to the magnet yoke, and electromagnetic coil means, and which is controlled by a control circuit with a microcontroller and using a control voltage supplied by a control voltage source. A retaining force ensuring the dropped-out state of the armature is produced by at least one return spring. Using the method, the permanent-magnet assisted electromagnetic pull-in mode against the retaining force, the exclusively permanent-magnetic holding mode, and the drop-out mode, which is provided electromagnetically against the permanent-magnetic holding force and assisted by the retaining force, are carried out in an energy-saving and reliable manner.

The flow chart shown in FIG. 1 starts with the initial state OFF of the method of the present invention, said initial state corresponding to the dropped-out state of the armature. First method step A checks whether control voltage Vi has risen to a value significantly different from zero. If this is the case, control voltage Vi causes the control circuit to be reset to a defined initial state and to be initialized. When control voltage Vi is applied, the charging of a charge storage device C1 begins.

In a subsequent method step B, the control circuit checks whether a main tripping coil L3, and an auxiliary tripping coil L4, which is redundant to said main tripping coil, are each able to move the armature from the holding position to the dropped-out position. Both tripping coils L3, L4 are electromagnetically coupled to the magnet yoke. To this end, in a first test step of method step B, auxiliary tripping coil L4 is energized for a period of 0.3 ms. If this test step runs successfully, a current supplied by the control voltage source flows briefly through auxiliary tripping coil L4. This current is detected as a voltage drop VR6 across a current-sensing resistor R6 connected to auxiliary tripping coil L4 and causes the control circuit to check whether charge voltage VC1 across charge storage device C1 has reached a predetermined sufficient level. If charge voltage VC1 is sufficiently high, the method goes to the second test step of method step B. Here, main tripping coil L3 is energized for a period of 0.3 ms. If this test step runs successfully, a current supplied by charge storage device C1 flows briefly through main tripping coil L3, but leaves enough charge in charge storage device C1 to ensure that the drop-out mode works properly. The brief current flow through main tripping coil L3 causes a brief voltage drop $-\Delta VC1$ across charge storage device C1. If the magnitude of voltage drop $-\Delta VC1$ is detected to be within a predetermined voltage window, the method goes to method step C. However, if, in the first test step, no voltage drop is detected across current-sensing resistor R6, or if, in the second test step, no voltage drop is detected across charge storage device C1 within the specified window, control voltage Vi is permanently disconnected by short-circuit tripping. Once control voltage Vi is permanently disconnected, the final state OUT OF SERVICE is reached. It is then impossible to energize the electromagnetic operating mechanism without previous repair. The failure of occurrence of voltage drop VR6 in the first test step means that it would also not be possible to return the armature to the dropped-out position using the redundant auxiliary tripping coil L4, if necessary, that is, when the returning of the armature using the main tripping coil fails. A failure of voltage drop −ΔVC1 across charge storage device C1 to reach the predetermined voltage window in the second test step means that the returning of the attracted armature to the dropped-out position using main tripping coil L3 would fail. On the other hand, if voltage drop −ΔVC1 exceeds the voltage window, then this means that the capacitance of charge storage device C1 has decreased to the point where the storable charge is no longer sufficient to return the attracted armature to the dropped-out position by discharging charge storage device C1 through main tripping coil L3.

After the control circuit detects that the test steps in method step B have completed successfully, the pull-in mode is performed in accordance with method step C in order for the electromagnetic operating mechanism to change to the ON state. To this end, a closing coil L1 is turned on until the attracted position of the armature is reliably reached, after which said closing coil is deactivated. Now, the armature is held exclusively by permanent-magnet action. Closing coil L1 and tripping coils L3, L4 are electromagnetically coupled to the magnet yoke. Closing coil L1 is turned on in a pulse-width modulated manner (for example, in accordance with DE 299 09 901 U1), and is connected to an activatable free-wheeling circuit FL. Free-wheeling circuit FL is activated as closing coil L1 is turned on in a pulse-width modulated manner, and is deactivated together with said closing coil. Upon completion of method step C, the ON state is assumed.

During the holding mode, which starts with the ON state, the following method step D tests, in two steps, the interrupting capability using tripping coils L3 and L4 without causing the armature to be moved out of its holding position. In the first and second test steps of method step D, analogously to method step B, auxiliary tripping coil L4 and main tripping coil L3 are turned on for 0.3 ms, respectively, and it is monitored whether a voltage drop VR6 occurs at current-sensing resistor R6 connected to auxiliary tripping coil L4, or whether a voltage drop −ΔVC1 falling within the predetermined voltage window occurs at the charge storage device C1 connected to main tripping coil L3, respectively. If the two test steps run successfully, they are repeated with a certain periodicity. However, if, at any time during the first test steps, no voltage drop is detected across current-sensing resistor R6, then initially the armature is moved to the dropped-out position by turning on main tripping coil L3 through discharging of charge storage device C1, and, by way of the OFF state, which has been reached in the meantime, the final state OUT OF SERVICE is assumed by short-circuiting control voltage Vi. However, if, at any time during the second test steps, no voltage drop is detected across charge storage device C1 within the specified window, then initially the armature is moved to the dropped-out position by turning on auxiliary tripping coil L4, which is supplied by the control voltage source, and, by way of the OFF state, which has been reached in the meantime, the final state OUT OF SERVICE is assumed by short-circuiting control voltage Vi.

When control voltage Vi is removed, whether through intentional control or because of a defect in the feeder or in the generation of control voltage Vi, the drop-out mode is carried out in accordance with method step E. In the process, charging capacitor C1 is discharged through turned-on main tripping coil L3, whereupon the armature moves to the dropped-out position and the electromagnetic operating mechanism changes to the OFF state, respectively. Now, the initial state OFF has been assumed again, from which the method may be restarted at method step A by reapplying control voltage Vi.

During the second test steps in method steps B and D, it is also checked whether an induced voltage rise occurs at closing coil L1 as a result of the brief current in main tripping coil L3 and because of the electromagnetic coupling between main tripping coil L3 and closing coil L1. If, in the second test step, the control circuit detects a significant voltage rise +ΔVL1, the method goes from method step B to method step C, or method step D is repeated periodically starting with the first test step, respectively. However, if during the second test step of method step B, no voltage rise +ΔVL1 is detected, the final state OUT OF SERVICE is assumed by short-circuiting control voltage Vi. On the other hand, if during one of the second test steps according to method step D, no voltage rise +ΔVL1 is detected at closing coil L1, then initially the armature is moved to the dropped-out position by turning on auxiliary tripping coil L4, which is supplied by the control voltage source, and, by way of the OFF state so reached, the final state OUT OF SERVICE is assumed by short-circuiting control voltage Vi. If the voltage rise +ΔVL1 expected during the second test step fails to occur, then this means that free-wheeling circuit FL is not inactive because of a defect, and that it therefore represents a short-circuit for induced voltage rises. This short-circuit would also occur in the normal drop-out mode in accordance with method step E. Due to the electromagnetic coupling between closing coil L1 and main tripping coil L3, if this short-circuit occurred during the discharging of charge storage device C1 through main tripping coil L3 in method step E, it would decrease the magnetic field strength in the magnet yoke significantly compared to the magnetic field strength occurring when free-wheeling circuit FL is inactive. When the magnetic field strength is reduced to such an extent, it is no longer guaranteed that the armature can be returned to the dropped-out position.

With the completion of method step A, the method additionally checks the microcontroller using watchdog signals, which are continuously output by the microcontroller when it works properly. Watchdog signals in connection with microcontrollers are described, for example, in U.S. Pat. No. 5,214,560 A. If the watchdog signals fail to appear, which may occur in the event of a program crash or a program hang-up, charge storage device C1 is discharged through main tripping coil L3 in accordance with method step E, after which the initial state OFF is assumed again.

The present invention is not limited to the above-described specific embodiment of the method, but encompasses all equally acting embodiments within the scope of the method claims. For example, the method may be modified such that in method steps B and D, the first and second test steps are swapped with each other with respect to their succession in time. In a further possible modification, the evaluation of a voltage rise +ΔVL1 expected in closing coil L1 is carried out during the first test step of method step D, that is, with respect to the inductive effect of the current briefly flowing through auxiliary tripping coil L4, or during both test steps. In yet another modification within the scope of the present invention, the retaining force to be exerted on the armature is additionally or alternatively produced by at least one further permanent magnet. Retaining springs for the retaining force are described, for example, in the above-mentioned German Patent DE 101 33 713 C1, while further permanent magnets for the retaining force are disclosed in European Patent EP 0 721 650 B1 mentioned earlier.

Figure 2:
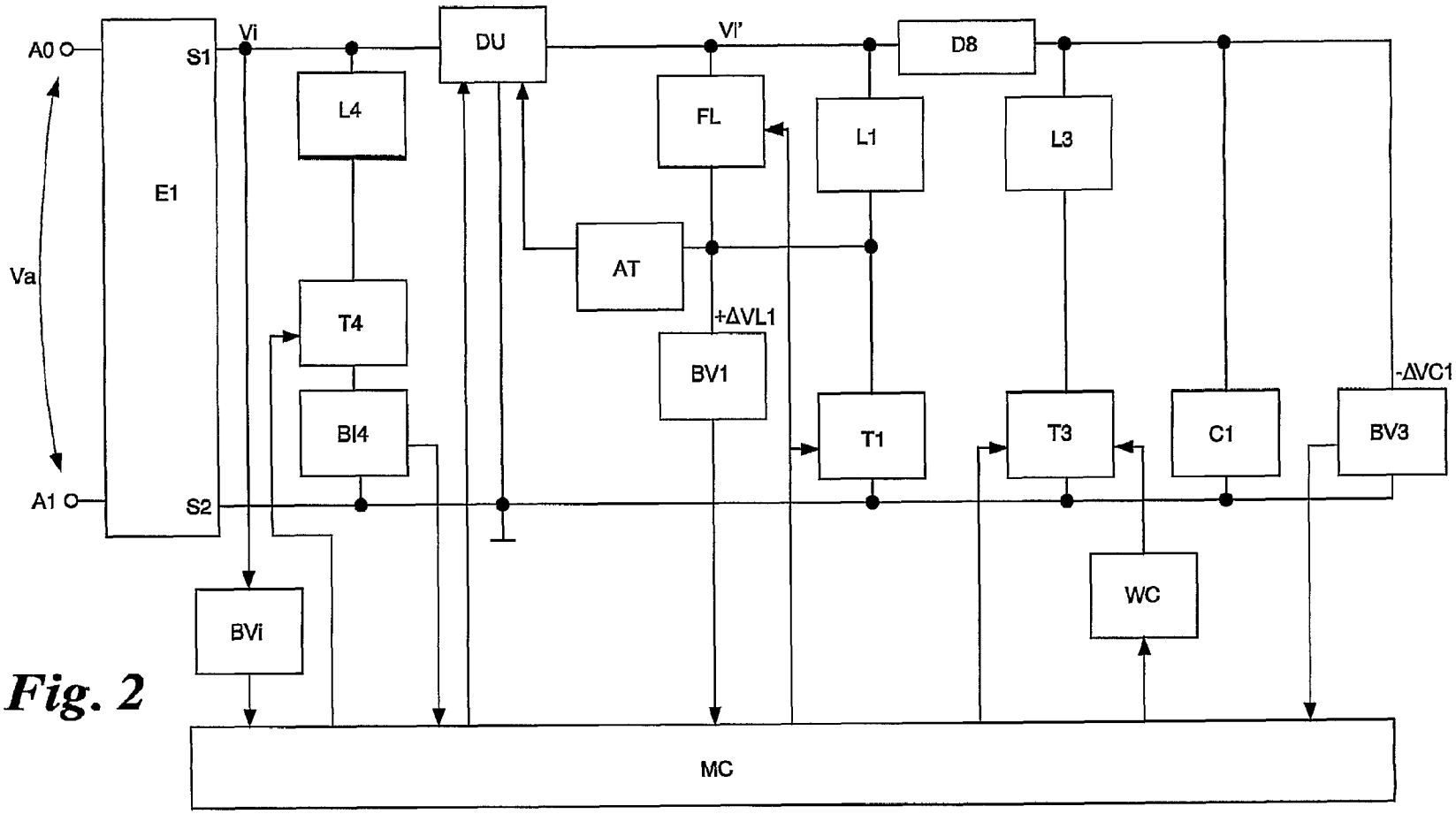
FIG. 2 is a block diagram of a circuit arrangement according to the present invention.

The circuit arrangement schematically illustrated below with reference to FIG. 2 is used to operate a generally known type of electromagnetic operating mechanism which includes a magnet yoke, at least one permanent magnet mounted thereto, an armature movably supported on the magnet yoke, and at least one return spring. The circuit arrangement includes electromagnetic coil means L1, L3 and L4 arranged around the magnet yoke, a control circuit which is supplied with a rectified control voltage Vi applied to its input and contains a microcontroller MC, and a capacitive charge storage device C1. When control voltage Vi is applied, the armature is attracted by the magnet yoke against the retaining force, assisted by permanent-magnet action, then held exclusively by permanent-magnet action while control voltage Vi remains applied, and when control voltage Vi is removed, the armature drops away from the yoke with the assistance of the retaining force and against the permanent-magnet holding force through discharging of charge storage device C1. Control voltage Vi is derived from a supply voltage Va via feed terminals S1 and S2 of an input circuit E1 containing means for rectifying and filtering or suppressing interference. Supply voltage Va is to be applied externally to supply terminals AO and A1. Supply voltage Va can be obtained from a DC or an AC voltage source and is turned on to initiate the pull-in mode and turned off to initiate the drop-out mode. The low-potential feed terminal S2 is connected to the ground potential of the control circuit. High-potential feed terminal S1 has connected thereto a control voltage controller BVi which initiates microcontroller MC when control voltage Vi has reached a sufficient level after application of supply voltage Va.

An auxiliary disabling branch formed by the series connection of an auxiliary tripping coil L4, an electronic auxiliary disabling element T4 and current-monitoring means B14 is connected directly to feed terminals S1, S2. Originating from high-potential feed terminal S1, control voltage Vi is fed to the other circuit elements via a trippable permanent interrupting element DU. An enabling branch formed by the series connection of a closing coil L1 and an electronic enabling element T1 is connected downstream of the permanent interrupting element. Also connected downstream of the permanent interrupting element is a series connection of a forward-biased decoupling diode D8 and a series-connected main disabling branch including a main tripping coil L3 and an electronic main disabling element T3. Charge storage device C1 and voltage-sensing means BV3 are both connected in parallel with main disabling branch L3-T3. Enabling branch L1-T1 and main disabling branch L3-T3, as well as charge storage device C1 and voltage-sensing means BV3 are supplied with a disconnectable control voltage Vi', which is equal to control voltage Vi when permanent interrupting element DU is conducting, and which is zero when the permanent interrupting element is in the tripped state. Inputs of microcontroller MC are connected to current-sensing means B14 and voltage-sensing means BV3. Outputs of microcontroller MC are connected to switching elements T1, T3 and T4 and to permanent interrupting element DU. Decoupling diode D8 prevents charge from flowing off the charge storage device C1 through enabling branch L1-T1 and through auxiliary disabling branch L4-T4-B14.

Microcontroller MC is programmed such that it is initialized by a reset signal occurring after some delay at the output of control voltage controller BVi upon application of control voltage Vi, that it causes auxiliary disabling element T4, and subsequently main disabling element T3, to turn on, i.e., to become conducting, for the purpose of testing, that it activates enabling element T1 in a pulse-controlled manner in order to move the armature to the attracted position, that it subsequently deactivates enabling element T1, and that when control voltage Vi is removed, it closes main disabling element T3 in order to move the armature to the dropped-out position, in which process the electromagnetic restoring force is obtained from the charge of charge storage device C1 flowing off through main tripping coil L3. The closing of disabling elements T3 and T4 for the purpose of testing occurs only during a short period of, for example, 0.3 ms, so that it will not affect the armature. If, while main disabling element T3 is turned on for testing purposes, microcontroller MC receives no output signal from voltage-sensing means BV3, it closes auxiliary disabling element T4. The current which is then supplied from feed terminals S1, S2 and flows through auxiliary tripping coil L4 returns the armature from the holding position to the dropped-out position, unless the armature was still in the dropped-out position. After that, microcontroller MC trips permanent interrupting element DU, so that the subsequent circuit elements are disconnected from control voltage Vi. However, if while auxiliary disabling element T4 is turned on for testing purposes, microcontroller MC receives no output signal from current-sensing means B14, it closes main disabling element T3. The current which is then supplied from charge storage device C1 and flows through main tripping coil L3 returns the armature from the holding position to the dropped-out position, unless the armature was still in the dropped-out position. In this case, too, microcontroller MC subsequently trips permanent interrupting element DU, so that the subsequent circuit elements are disconnected from control voltage Vi.

Closing coil L1 and enabling element T1 have connected thereto an active low-pass filter AT whose output is connected to permanent interrupting element DU. When enabling element T1 is turned on in a pulse-controller manner, active low-pass filter AT alternately charges and discharges without reaching a predetermined tripping voltage. If enabling element T1 can no longer be blocked because of a defect, then active low-pass filter AT reaches the tripping voltage, thus tripping permanent interrupting element DU in order to disconnect the subsequent circuit elements from control voltage Vi.

To protect enabling element T1 from overvoltages and to quickly remove the magnetic energy, a free-wheeling circuit FL is placed in parallel with closing coil L1 in a generally known manner. In the drop-out mode, free-wheeling circuit FL would represent a significant additional load for charging capacitor C1 because of the electromagnetic coupling through mutual inductance between closing coil L1 and main tripping coil L3. Due to this additional load, the charge stored on charge storage device C1 would no longer be sufficient to reliably return the armature to the dropped-out position. Therefore, free-wheeling circuit FL is designed as an activatable free-wheeling circuit, which is activated and deactivated by microcontroller MC together with enabling element T1. This means that free-wheeling circuit FL, which is deactivated outside the pull-in mode, is unable to place a load on charging capacitor C1 in the drop-out mode. During the testing of main disabling branch L3-T3, with free-wheeling circuit FL in the deactivated state, the brief current flow through main tripping coil L3 induces a voltage rise +ΔVL1, which is signaled to the microcontroller MC via further voltage-sensing means BV1. If, while main disabling element T3 is turned on for testing purposes, voltage rise +ΔVL1 fails to occur, auxiliary disabling element T4 is turned on in order for the armature to assume the dropped-out position, and then permanent interrupting element DU is tripped.

Furthermore, microcontroller MC controls a watchdog circuit WC which, in the event of a failure of microcontroller MC, causes the armature to be moved from the attracted position to the dropped-out position by closing main disabling element T3.

Figure 3:
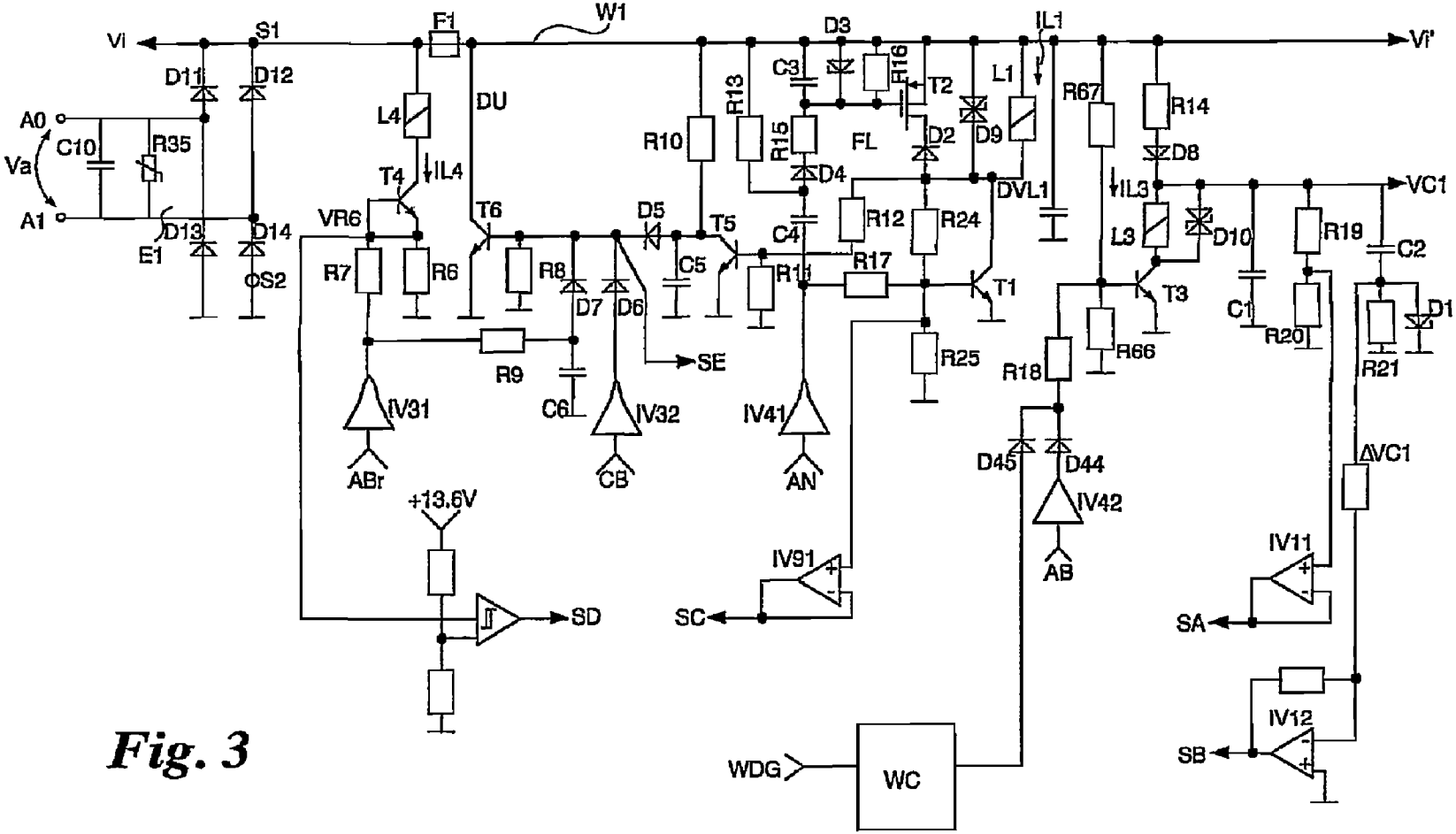
FIG. 3 shows a detail from FIG. 2.
Figure 4:
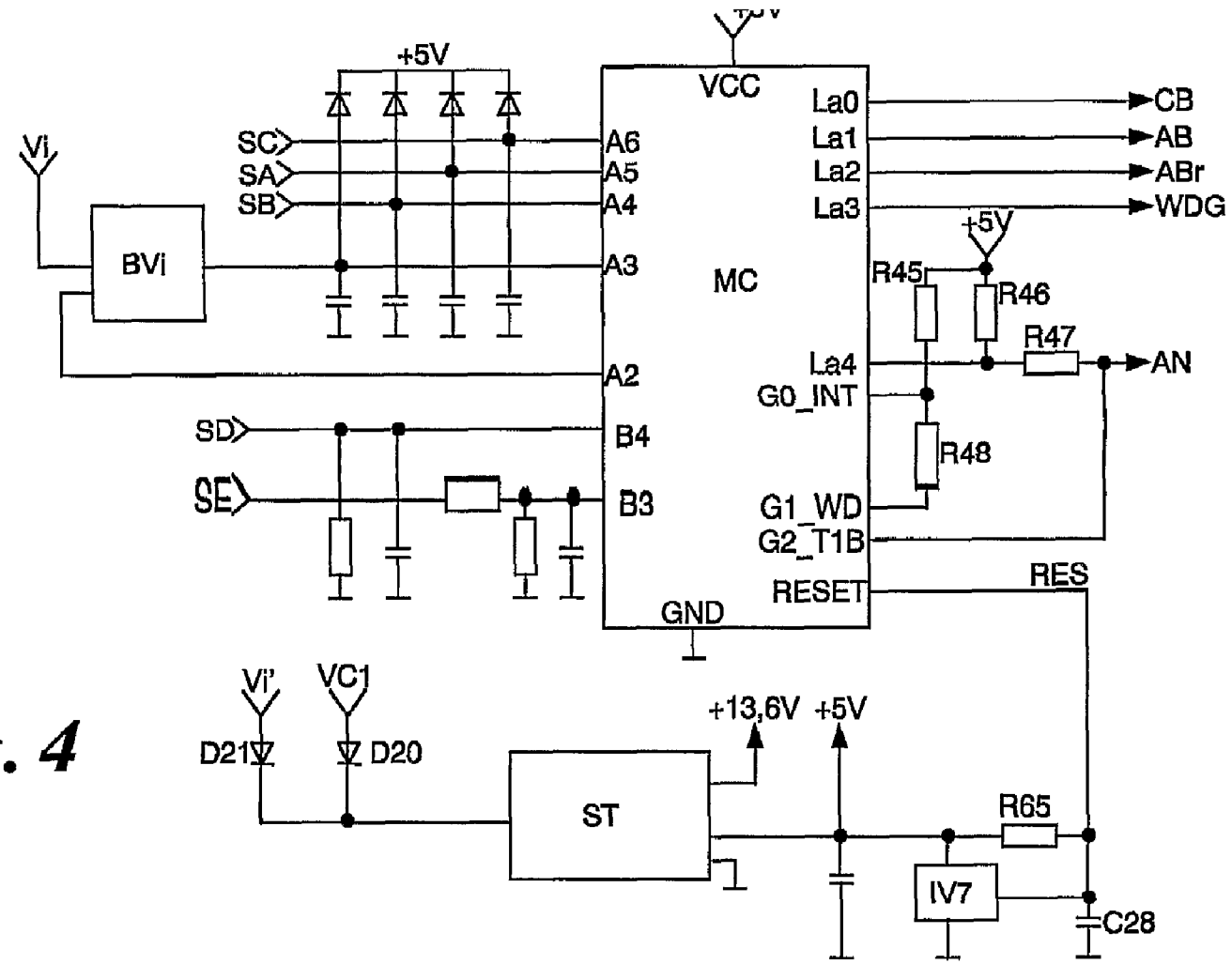
FIG. 4 shows a further detail from FIG. 2.

FIG. 3 and FIG. 4 show, by way of example, details of the circuit arrangement of FIG. 2. Input circuit E1 is formed by an interference-suppression capacitor C10 and a voltage-limiting resistor R35 on the input side, and a full-wave rectifier including rectifier diodes D11 through D14 on the output side. The control voltage Vi present at the output of full-wave rectifier D11-D14, i.e. at feed terminals S1, S2, passes through permanent interrupting element DU as a disconnectable control voltage Vi'. Permanent interrupting element DU includes a short-circuit protective device F1 inserted in control voltage line W1, and a subsequent semiconductor-type short-circuit switching element T6 placed between control voltage line W1 and the ground potential. Microcontroller MC provides at an output La0 a short-circuit signal CB which is delivered via an integrated amplifier IV32 and a first OR diode D6 to the base electrode of short-circuit switching element T6.

Control voltage Vi is supplied via control voltage controller BVi to a terminal A3 of microcontroller MC and, using usual means and in conjunction with a terminal A2 of microcontroller MC, determines the service-readiness of microcontroller MC with respect to the control voltage Vi building up and the pulse-width during pulse-width controlled activation of enabling element T1.

Disconnectable control voltage Vi' is supplied to charge storage device C1 via a charging resistor R14 and decoupling diode D8. Disconnectable control voltage Vi' and charge voltage VC1 across charge storage device C1 are separately supplied to a switched-mode power supply unit ST via decoupling diodes D21 and D20. Switched-mode power supply unit ST provides the DC supply voltage of +13.6 V required for the voltage supply to the control circuit, as well as the supply voltage of +5 V derived therefrom. In the pull-in mode and in the holding mode, switched-mode power supply unit ST, and thus the control circuit, are supplied with disconnectable control voltage Vi'. However, in the drop-out mode, switched-mode power supply unit ST, and thus the control circuit, are supplied with charge voltage VC1. The +5 V output of switched-mode power supply unit ST is also connected to a reset circuit, which is formed by an integrated amplifier IV7, an integrating capacitor C28 on the output side, and a feedback resistor R65 in a usual manner. When disconnectable control voltage Vi' builds up after application of supply voltage Va, amplifier IV7 sends a reset signal RES to the RESET input of microcontroller MC, whereupon microcontroller MC is reset to a defined initial state.

The auxiliary disabling branch is formed by auxiliary tripping coil L4, semiconductor-type auxiliary disabling element T4, and the current-monitoring resistor R6 placed in the emitter circuit of said current-monitoring resistor R6. Microcontroller MC outputs, at an output La2, a testing auxiliary disable signal ABr which returns the armature, if required. Auxiliary disable signal ABr is fed to the base electrode of auxiliary disabling element T4 via an integrated amplifier IV31 and a series resistor R7. Auxiliary disable signal ABr has a duration of 0.3 ms for the testing of auxiliary disabling branch L4-T4-R6, whereupon a brief current should flow through current-sensing resistor R6. Voltage drop VR6, which then develops across current-sensing resistor R6, is fed as an auxiliary confirmation signal SD via a first amplifier circuit IV21 to an input B4 of microcontroller MC. Current-sensing resistor R6 and first amplifier circuit IV21 are equivalent to current-sensing means B14 of FIG. 2. Moreover, the output of amplifier IV31 is connected to the base electrode of short-circuit switching element T6 via a delay element and a second OR diode D7, said delay element including a delay resistor R9 and a delay capacitor C6. Via this connection, permanent interrupting element DU is tripped too in the event that main disabling branch L3-T3 fails after the armature-returning closing of auxiliary disabling element T4.

The main disabling branch is formed by main tripping coil L3, semiconductor-type main disabling element T3 and a first suppressor diode D10 as a free-wheeling circuit for main tripping coil L3. Microcontroller MC outputs, at an output La1, a testing main disable signal AB which returns the armature, if required. Main disable signal AB is fed, via an integrated amplifier IV42, a fourth OR diode D44 and a series resistor R18, to the base electrode of main disabling element T3, said base electrode having connected thereto divider resistors R66, R67. Main disable signal AB has a duration of 0.3 ms for the testing of main disabling branch L3-T3-D10, whereupon a measurable voltage drop −ΔVC1 should occur at charge storage device C1. Voltage drop −ΔVC1 is fed as a main confirmation signal SB via a passive high-pass filter and a second amplifier circuit IV12 to a terminal A4 of microcontroller MC, said passive high-pass filter including a differentiating capacitor C2, a bleed resistor R21, and a limiter diode D1. Microcontroller MC monitors whether voltage drop −ΔVC1 is within a predetermined window. Too low a voltage drop −ΔVC1 means that an absence or too low a coil current IL3 in main tripping coil L3 will not cause the armature to be returned during the drop-out mode. On the other hand, too high a voltage drop −ΔVC1 means that the capacitance of charge storage device C1 is no longer sufficient to provide enough current flow through main tripping coil L3 during the drop-out mode. Capacitor C1 further has connected thereto a third amplifier circuit IV11 via a voltage divider formed by divider resistors R19, R20, said third amplifier circuit IV11 providing at its output a voltage control signal SA which is proportional to charge voltage VC1 and which is delivered to a terminal A5 of microcontroller MC. Based on voltage control signal SA, microcontroller MC checks whether, after application of control voltage Vi, charge storage device C1 has been charged to a level sufficient to ensure the drop-out mode. Voltage-sensing means BV1 of FIG. 2 are formed by high-pass filter C2-R21, voltage divider R19-R20 and second and third amplifier circuits IV12 and IV11.

Microcontroller MC periodically outputs watchdog signals WDG at an output La3, said watchdog signals being monitored by a watchdog circuit WC. Watchdog circuit WC is known per se from Publication WO 03 077 396 A1 and includes a high-pass filter, a charging capacitor capable of being discharged in the rhythm of watchdog signals WDG, as well as a voltage comparator. The output of watchdog circuit WC is connected via a fifth OR diode to series resistor R18. In the event that microcontroller MC is faulty, watchdog signals WDG fail to appear, whereupon watchdog circuit WC initiates the drop-out mode by closing main disabling element T3.

The enabling branch is formed by closing coil L1, semiconductor-type enabling element T1, activatable free-wheeling circuit FL and a suppressor diode D9, which serves for additional overvoltage protection. Microcontroller MC outputs a pulse-width modulated enable signal AN via an output La4 and a resistor circuit R45 through R48 Enable signal AN is fed to the base electrode of enabling element T1 via an integrated amplifier IV41 and a series resistor R17. Activatable free-wheeling circuit FL includes a high-pass filter, which is formed by a differentiating capacitor C4 and a bleed resistor R13 and is connected downstream of the output of amplifier IV41, the free-wheeling circuit further including a charging circuit which is formed by a series connection of a rectifier diode D4, a charging resistor R15, a charging capacitor C3, a limiter diode D3 and a discharge resistor R1 and starts at high-pass filter C4-R13, the free-wheeling circuit further including a series circuit which is connected in parallel with closing coil L1 and which is formed by a free-wheeling diode D2 and a semiconductor-type activation switching element T2 whose gate electrode is connected to charging capacitor C3. Upon pulse-controlled activation of enabling element T1, charging capacitor C3 starts to be "pumped up" in the rhythm of the pulses of enable signal AN present at amplifier IV41. After a few pulses of enable signal AN, the voltage across charging capacitor C3 has increased to the point where activation switching element T2 closes, actively connecting free-wheeling diode D2 to closing coil L1. Now, free-wheeling circuit FL is in the active state. When enable signal AN ceases, charging capacitor C3 is discharged through discharge resistor R16, in which process free-wheeling diode D2 is disconnected from closing coil L1 by the blocking of activation switching element T2. Thus, free-wheeling circuit FL has returned to the inactive state.

The junction point between closing coil L1, enabling element T1 and activatable free-wheeling circuit FL is connected via a voltage divider R24-R25 to a fourth amplifier circuit IV91. Voltage rise +ΔVL1 induced in closing coil L1 during the testing of main disabling branch L3-T3-D10 while free-wheeling circuit FL is deactivated is fed as a blocking control signal SC via a fourth amplifier circuit IV91 to an input A6 of microcontroller MC. Voltage divider R24-R25 and fourth amplifier circuit IV91 are equivalent to the further voltage-sensing means BV1 of FIG. 2.

The junction point between closing coil L1, enabling element T1 and free-wheeling circuit FL is connected via a further voltage divider R11-R12 to the base electrode of a switching transistor T5 whose collector electrode is connected to a charging resistor R10 and a further charging capacitor C5 Charging capacitor C5 is connected via a third OR diode D5 to the base electrode of short-circuit switching element T6. Outside the pull-in mode, enabling element T1 is blocked, as a result of which charging capacitor C5 is discharged through the collector-emitter path of switching transistor T5, which is closed by closing coil L1 and voltage divider R11-R12. In the pull-in mode, the voltage pulses occurring across enabling element T1 in the pulse rhythm of enable signal AN cause switching transistor T5 to be alternately closed and blocked, so that no significant voltage can develop across the alternately charged and discharged charging capacitor C5. However, in the event that enabling element T1 is permanently closed due to a defect (generally resulting from breakdown), switching transistor T5 is permanently blocked. Then, as the charging of charging capacitor C5 through charging resistor R10 proceeds, short-circuit switching element T5 is closed, after which the short-circuit protective device F1 trips, thus permanently disconnecting disconnectable control voltage Vi'. The electromagnetic operating mechanism is prevented from being energized. Voltage divider R11-R12, switching transistor T5, charging resistor R10 and charging capacitor C5 together are equivalent to active low-pass filter AT of FIG. 2. A trip signal SE is carried from the junction of first through third OR diodes D5 through D7 and a junction resistor R8 to an input B3 of microcontroller MC. Upon receipt of a trip signal SE, microcontroller MC outputs a main disable signal AB as a precautionary measure so as to return the armature, which may already have been attracted.

In addition to the above-described monitoring of enabling element T1 for proper functioning, the circuit arrangement also includes further self-monitoring functions, which will be described below, said further self-monitoring functions ensuring that the circuit arrangement and the electromagnetic operating mechanism change to a defined safety state.

In the event of broken wires to or in main tripping coil L3, or in case main disabling element T3 is permanently blocked, no main confirmation signal SB is output by second amplifier circuit IV12 after main disable signal AB is output for the purpose of testing because of the failure of a voltage drop −ΔVC1 to occur at charge storage device C1. Then, microcontroller MC initially outputs an auxiliary disable signal ABr to return the armature to the dropped-out position, and then a short-circuit signal CB to permanently disconnect disconnectable control voltage Vi'. After that, the electromagnetic operating mechanism is no longer operable.

In case the capacitance of charge storage device C1 should have decreased to a level which is no longer tolerable, or in the event of a breakdown of suppressor diode D10 connected to main tripping coil L3, a main confirmation signal SB exceeding the predetermined window is output by second amplifier circuit IV12 after main disable signal AB is output for the purpose of testing because of too high a voltage drop −ΔVC1 at charge storage device C1. Then, microcontroller MC initially outputs an auxiliary disable signal ABr to return the armature to the dropped-out position, and then a short-circuit signal CB to permanently disconnect disconnectable control voltage Vi'. After that, the electromagnetic operating mechanism is no longer operable.

If the activatable free-wheeling circuit is always in the active state, no blocking control signal SC is output by fourth amplifier circuit IV91 after main disable signal AB is output for the purpose of testing because of a hardly detectable voltage rise +ΔVL1 at closing coil L1. Then, microcontroller MC initially outputs an auxiliary disable signal ABr to return the armature to the dropped-out position, and then a short-circuit signal CB to permanently disconnect disconnectable control voltage Vi'. After that, the electromagnetic operating mechanism is no longer operable.

In the event that main disabling element T3 breaks down, i.e., if it is permanently conducting, no voltage control signal SA is output by third amplifier circuit IV11 after control voltage Vi is applied because a required charge voltage VC1 across charge storage device C1 fails to be reached. Then, microcontroller MC outputs a short-circuit signal CB to permanently disconnect disconnectable control voltage Vi'. After that, the electromagnetic operating mechanism is no longer operable.

In the event of broken wires to or in auxiliary tripping coil L4, or in case auxiliary disabling element T4 is permanently blocked, no auxiliary confirmation signal SD is output by first amplifier circuit IV21 after auxiliary disable signal ABr is output for the purpose of testing because of the failure of a voltage drop VR6 to occur at current-sensing resistor R6. Then, microcontroller MC initially outputs a main disable signal AB to return the armature to the dropped-out position, and then a short-circuit signal CB to permanently disconnect disconnectable control voltage Vi'. After that, the electromagnetic operating mechanism is no longer operable.

In the event that auxiliary disabling element T4 breaks down, i.e., if it is permanently conducting, no voltage control signal SA is output by third amplifier circuit IV11 after control voltage Vi is applied because a required charge voltage VC1 across charge storage device C1 fails to be reached. Then, microcontroller MC outputs a short-circuit signal CB to permanently disconnect disconnectable control voltage Vi'. After that, the electromagnetic operating mechanism is no longer operable.

Upon breakdown of short-circuit switching element T6, two alternative cases may arise when control voltage Vi collapses. In the first case, main disable signal AB is output, causing the armature to return to the dropped-out position before short-circuit protective device F1 subsequently trips. In the second case, short-circuit protective device F1 trips after the voltage drop detected via fourth amplifier circuit IV91 has caused microcontroller MC to output an auxiliary disable signal ABr to return the armature. Here too, the electromagnetic operating mechanism is no longer operable in either of the two cases.

In the event of a failure of the +5 V DC supply voltage, watchdog circuit WC causes the armature to return to the dropped-out position when watchdog signals WDG fail to appear. In the event of a failure of the +13.6 V DC supply voltage, watchdog circuit WC and integrated amplifier IV42 become inactive. By closing main disabling element T3 via the voltage divider R66-R67 connected to its base electrode, the armature is returned to the dropped-out position. The electromagnetic operating mechanism is no longer operable until the DC supply voltages are restored.

Figure 5:
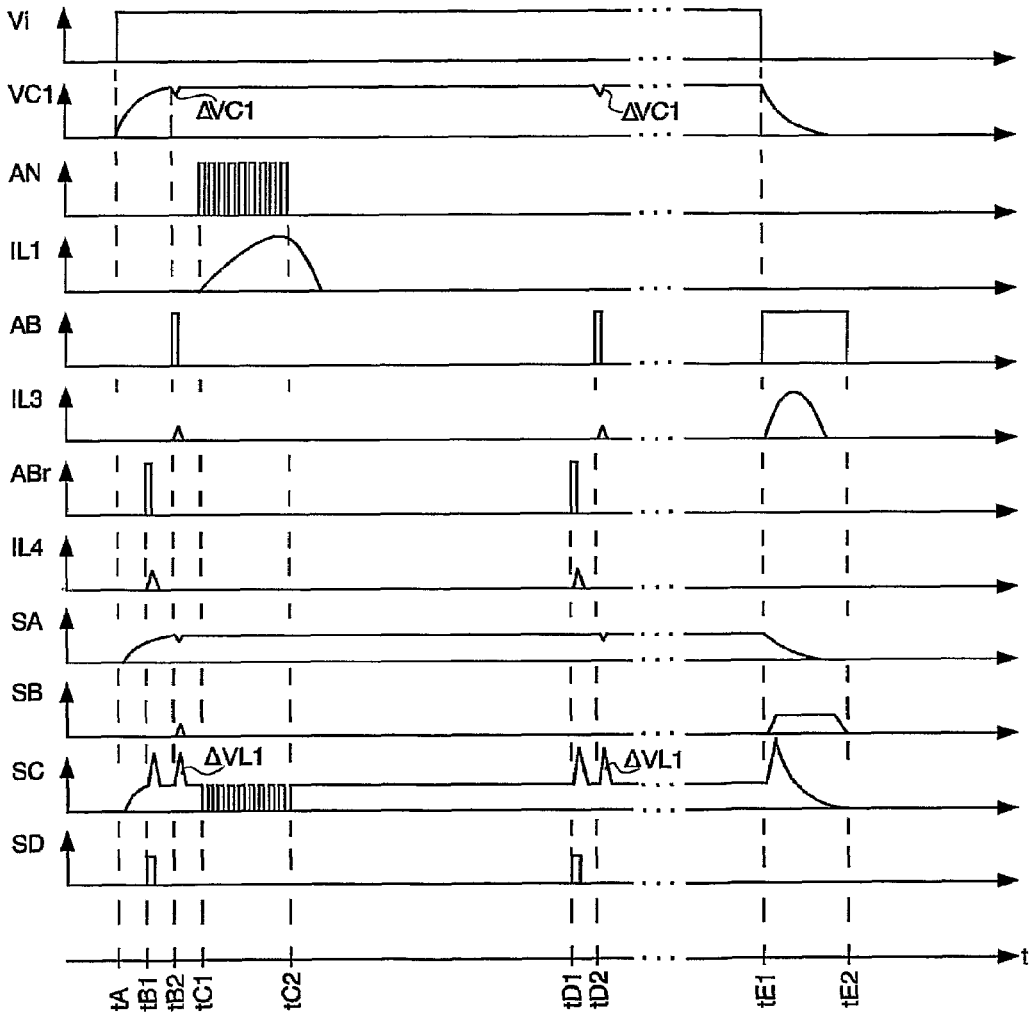
FIG. 5 contains timing diagrams to illustrate the method and the circuit arrangement.

The timing diagrams in FIG. 5 demonstrate both the sequence of the method according to the present and the operation of the inventive circuit arrangement without any of the failure phenomena described above. Upon application of control voltage Vi at instant tA, charge voltage VC1 is developed by charging charge storage device C1 in accordance with method step A, in which process the level of charge voltage VC1 is monitored using voltage control signal SA. Method step B starts at instant tB1 with the output of an auxiliary disable signal ABr of 0.3 ms for the testing of the auxiliary disabling circuit, whereupon the brief current IL4 through auxiliary tripping coil L4 generates an auxiliary confirmation signal SD. At a subsequent instant tB2, a main disable signal AB is output to test the main disabling branch, whereupon the brief voltage drop −ΔVC1 of charge voltage VC1 generates a main confirmation signal SB. Brief auxiliary interrupting current IL4 and brief main interrupting current IL3 induce voltages in closing coil L1 which, in the case of the voltage rise +ΔVL1 induced by brief main interrupting current IL3, are output in the form of blocking control signal SC. Method step C starts at instant tC1 and ends at instant tC2 with pulse-width controlled enable signal AN. With the delayed decay of a current IL1 through closing coil L1 of considerable duration, the pull-in mode ends and the holding mode begins.

In accordance with method step D, the auxiliary disabling branch and the main disabling branch are tested periodically during the holding mode by outputting auxiliary disable signals ABr and main disable signals AB of a period of 0.3 ms each at instants tD1 and tD2, respectively. Here too, the auxiliary confirmation signals SD and main confirmation signals SB are output as a result of brief coil currents IL4 and IL3, respectively, and the voltage rises +ΔVL1 are impressed on blocking control signal SC as a result of brief coil current IL3. The removal of control voltage Vi at instant tE1 terminates the holding mode and starts the drop-out mode in accordance with method step E. The output of a main disable signal AB of considerable duration causes a current IL3 supplied by charge storage device C1 to flow through main tripping coil L3, as a result of which the armature is retuned to the dropped-out position. In this process, charge voltage VC1 falls to nearly zero. When main disable signal AB ceases at instant tE2, the drop-out mode ends, the electromagnetic operating mechanism has thus entered its de-energized state and is ready again to change to the pull-in mode when control voltage Vi is applied again.

It should be added that the voltage rises impressed on blocking control signal SC are caused by both the inductive coupling between auxiliary tripping coil L4 and closing coil L1 and the inductive coupling between main tripping coil L3 and closing coil L1.

Here too, the present invention can be modified, without departing from its scope, such that the retaining force to be exerted on the armature is additionally or alternatively produced by at least one further permanent magnet. Retaining springs for the retaining force are described, for example, in the above-mentioned German Patent DE 101 33 713 C1, while further permanent magnets for the retaining force are disclosed, for example, in European Patent EP 0 721 650 B1 mentioned earlier.

What is claimed is:

1. A method for operating an electromagnetic operating mechanism including a magnet yoke, a permanent magnet, an armature, and electromagnetic coil device, a control circuit including a microcontroller, the electromagnetic operating mechanism having:

a permanent-magnet assisted electromagnetic pull-in mode provided against a retaining force upon application of a control voltage to the control circuit;

a subsequent, permanent-magnetic holding mode provided while the control voltage remains applied; and a drop-out mode provided electromagnetically against the permanent-magnetic holding force and assisted by the retaining force, a capacitive charge storage device charged during the pull- in and holding modes being discharged upon removal of the control voltage so as to cause the drop-out mode;

the method comprising the following steps:

A) upon application of the control voltage, resetting and initializing the control circuit and starting a charging of the charge storage device;

B) subsequently sequentially briefly energizing an auxiliary tripping coil and a main tripping coil, and, if no current flow occurs through at least one of the auxiliary and main tripping coils, permanently disconnecting the control voltage;

C) if a current flow occurs through each of the tripping coils, energizing a closing coil so as to move the armature to an attracted position, and subsequently de-energizing the closing coil;

D) subsequently sequentially briefly energizing the auxiliary tripping coil and the main tripping coil without affecting the armature, and if no current flow occurs through the auxiliary tripping coil, discharging the charge storage device through the main tripping coil so as to move the armature to a dropped-out position, if no current flow occurs through the main tripping coil, energizing the auxiliary tripping coil so as to move the armature to the dropped-out position, and then permanently disconnecting the control voltage;

E) if a current flow occurs through each of the tripping coils, re-starting step D; and F) upon removal of the control voltage, discharging the charge storage device through the main tripping coil so as to move the armature to the dropped-out position.

2. The method as recited in claim 1 further comprising checking, prior to the briefly energizing the main tripping coil as recited in step B, a charge state of the charge storage device.

3. The method as recited in claim 1 wherein the permanent disconnecting of the control voltage as recited in steps B and D is performed using a short-circuit tripping.

4. The method as recited in claim 1 wherein the current flow through the auxiliary tripping coil as recited in steps C and E is detected as a resistive voltage drop.

5. The method as recited in claim 1 wherein the current flow through the main tripping coil as recited in steps C and E is detected as a voltage drop across the charge storage device.

6. The method as recited in claim 5 further comprising, when the voltage drop across the charge storage device is too low or too high, energizing the auxiliary tripping coil prior to the permanently disconnecting the control voltage.

7. The method as recited in claim 1 further comprising, when a voltage rise induced on the closing coil as a result of the current flow through either of the main and auxiliary tripping coils fails to occur, energizing the respective other tripping coil as necessary to move the armature to the dropped-out position, and permanently disconnecting the control voltage.

8. The method as recited in claim 1 further comprising, in an event of a failure of the microcontroller, discharging the charge storage device through the main tripping coil so as to move the armature to the dropped-out position.

9. The method as recited in claim 1 further comprising, in an event of a failure of the microcontroller, energizing die auxiliary tripping coil so as to move the armature to the dropped-out position.

10. The method as recited in claim 1 wherein the retaining force is provided by at least one return spring operatively connected to the armature.

11. The method as recited in claim 1 wherein the retaining force is provided by at least one further permanent magnet operatively connected to the armature.

12. The method as recited in claim 1 wherein further comprising checking, prior to the briefly energizing the main tripping coil as recited in step B, a charge state of the charge storage device.

13. A circuit arrangement for operating an electromagnetic operating mechanism including a magnet yoke, at least one permanent magnet disposed at a side of the magnet yoke, an armature, a retaining device configured to exert a retaining force, and an electromagnetic coil device surrounding the magnet yoke, wherein, upon application of a control voltage, the armature is configured to be attracted against the retaining force, assisted by permanent-magnet action, then to be held by permanent-magnet action while the control voltage remains applied, and when the control voltage is removed, the armature is configured to drop out with assistance of the retaining force and against the permanent-magnet holding force, the circuit arrangement comprising:

a capacitive charge storage device configured to discharge so as to permit the armature to drop out; and a control circuit configured to be supplied with a rectified control voltage applied to its input and including a microcontroller, the control circuit including:

a trippable permanent interrupting element configured to permanently disconnect the control voltage, the control voltage being supplied via feed terminals;

an auxiliary disabling branch connected to the feed terminals and including a series connection of an auxiliary tripping coil, an auxiliary disabling element, and a current-sensing device;

an enabling branch connected downstream of the permanent interrupting element and including a series connection of a closing coil and an enabling element;

a main disabling branch connected downstream of the permanent interrupting element and including a series connection of a forward-biased decoupling diode, a main tripping coil and a main disabling element, the charge storage device being connected in parallel with the main tripping coil and the main disabling element; and a voltage-sensing device connected in parallel with the charge storage device;

wherein:

a plurality of first connections connect an input side of the microcontroller to the current-sensing device, the voltage-sensing device, and to a control voltage controller, an input side of the control voltage controller being connected to the feed terminals;

a plurality of second connections connect an output side of the microcontroller to the auxiliary disabling element, the enabling element and the main disabling element and to the permanent interrupting element;

the microcontroller is programmed so as to:

be initialized upon application of the control voltage;

be briefly close the auxiliary and main disabling elements in a predeterminable order without affecting the armature;

activate the enabling element in a pulse-controlled manner so as to move the armature to an attracted position;

subsequently deactivate the enabling element;

when the control voltage is removed, close the main disabling element so as to move the armature to a dropped-out position;

if a respective output signal of the current-sensing device or of the voltage-sensing device fails to appear, immediately close at least one of the main and auxiliary disabling element so as to move the armature to the dropped-out position, and subsequently trip the permanent interrupting element.

14. The circuit arrangement as recited in claim 13 wherein the permanent interrupting element includes a short-circuit protective device and a downstream short-circuit switching element, the short-circuit protective device being connected to one of the feed terminals.

15. The circuit arrangement as recited in claim 14 further comprising a charging capacitor configured to discharge or charge when the enabling element is blocked or open, respectively, and an active low-pass filter connected on an input side thereof to the closing coil and on an output side thereof to the short-circuit switching element so that the charging capacitor closes the short-circuit switching element when a predetermined charge voltage is reached.

16. The circuit arrangement as recited in claim 13 wherein the current-sensing device includes a current-sensing resistor and a first amplifier circuit originating at the current-sensing resistor.

17. The circuit arrangement as recited in claim 13 wherein the voltage-sensing device includes a high-pass filter connected to the charge storage device, and a second amplifier circuit, the second amplifier circuit originating at the high-pass filter and being connected to the microcontroller.

18. The circuit arrangement as recited in claim 17 wherein the voltage-sensing device include a third amplifier circuit, the third amplifier circuit originating at the charge storage device and being connected to the microcontroller.

19. The circuit arrangement as recited in claim 13 further comprising an activatable free-wheeling circuit and a further voltage-sensing device connected to the closing coil and configured to detect a voltage rise induced during a brief closing of at least one of the main tripping coil and the auxiliary tripping coil and to provide the voltage rise to the microcontroller, and wherein, if the voltage rise fails to occur, the microcontroller is configured to close at least one of the auxiliary disabling element and the main disabling element so as to move the armature to the dropped-out position and then trip the permanent interrupting element.

20. The circuit arrangement as recited in claim 13 wherein the retaining device includes at least one return spring operatively connected to the armature.

21. The circuit arrangement as recited in claim 13 wherein the retaining device includes at least one further permanent magnet operatively connected to the armature.

* * * * *